US010968876B2

(12) United States Patent
Matos et al.

(10) Patent No.: US 10,968,876 B2
(45) Date of Patent: Apr. 6, 2021

(54) ENGINE AIR INTAKE DUCT WITH ORIFICE CAP AND MANUFACTURE THEREOF

(71) Applicant: Ford Global Technologies, LLC, Dearborn, MI (US)

(72) Inventors: Ivan Lage Matos, Bahia (BR); Guilherme Augusto Lopes Da Silva, Sao Paulo (BR)

(73) Assignee: Ford Global Technologies, LLC, Dearborn, MI (US)

( * ) Notice: Subject to any disclaimer, the term of this patent is extended or adjusted under 35 U.S.C. 154(b) by 326 days.

(21) Appl. No.: 15/872,438

(22) Filed: Jan. 16, 2018

(65) Prior Publication Data

US 2019/0219013 A1 Jul. 18, 2019

(51) Int. Cl.
*F02M 35/12* (2006.01)
*F02M 35/10* (2006.01)

(52) U.S. Cl.
CPC .. *F02M 35/1216* (2013.01); *F02M 35/10118* (2013.01); *F02M 35/10144* (2013.01)

(58) Field of Classification Search
CPC ..... F02M 35/1216; F02M 35/10118; F02M 35/10144
See application file for complete search history.

(56) References Cited

U.S. PATENT DOCUMENTS

| | | | | |
|---|---|---|---|---|
| 6,830,024 | B2 | 12/2004 | Kodweiss et al. | |
| 7,451,733 | B2 | 11/2008 | Kwack | |
| 8,528,692 | B2 * | 9/2013 | Teshima | F02M 35/10144 123/184.53 |
| 8,763,752 | B2 | 7/2014 | Tange et al. | |
| 9,951,728 | B2 * | 4/2018 | Ostler | F01N 1/24 |
| 9,970,351 | B2 * | 5/2018 | Zuroski | F02M 35/02491 |
| 2002/0112708 | A1 * | 8/2002 | Fischer | F02M 35/10222 123/568.17 |
| 2003/0041832 | A1 * | 3/2003 | Kodweiss | F02M 35/1036 123/184.53 |
| 2006/0006012 | A1 * | 1/2006 | Khouw | F02M 35/161 180/68.3 |
| 2013/0213732 | A1 * | 8/2013 | Bornemann | F02M 35/10144 181/212 |

FOREIGN PATENT DOCUMENTS

| | | | |
|---|---|---|---|
| CN | 205064145 | U | 3/2016 |
| CN | 206071771 | U | 4/2017 |
| JP | 2010275916 | A | 12/2010 |

* cited by examiner

*Primary Examiner* — Joseph J Dallo
*Assistant Examiner* — Kurt Philip Liethen
(74) *Attorney, Agent, or Firm* — Brooks Kushman P.C.

(57) ABSTRACT

An engine air intake duct includes a duct wall and an orifice cap. The duct wall extends between an air inlet and an air outlet and has at least one orifice disposed therethrough. The duct wall has an integrally-formed closure mechanism adjacent the orifice. The orifice cap is moveable relative to and securable to the closure mechanism to substantially cover the orifice.

4 Claims, 3 Drawing Sheets

ENGINE AIR INTAKE DUCT WITH ORIFICE CAP AND MANUFACTURE THEREOF

TECHNICAL FIELD

The present disclosure relates to an air induction system, and more specifically to an air induction system for an internal combustion engine of an automobile.

BACKGROUND

Internal combustion engines employed to power vehicles generally operate with air intake systems that include an air intake duct to direct the air flow into the engine. Air intake ducts often present acoustic resonances. Various approaches have been implemented to mitigate such acoustic resonances. However, some approaches provide an ingress through which engine-heated air may enter the intake duct, which may reduce engine thermal efficiency. Furthermore, some approaches provide an ingress through which water may enter the intake duct.

SUMMARY

In at least one approach, a vehicle is provided. The vehicle may include an engine and an air intake system. The air intake system may be adapted to direct fluid to the engine. The air intake system may have an air intake duct that includes a first body portion secured to a second portion to form a shell. The shell may define an air inlet at a first end and an air outlet at a second end opposite the first end. The first body portion may define a plurality of orifices disposed therethough. The first body portion may further define an integrally-formed closure interface including a closure frame, a hinge, and an orifice cap. The closure frame may have an upstanding wall extending from the first body portion at a perimeter of the plurality of orifices and an upstanding closure member extending from the first body portion. The hinge may be connected to and extend from the closure frame. The orifice cap may be connected to and extend from the hinge and may have an aperture sized to receive the upstanding closure member. The orifice cap may be rotatable between a first position in which the orifice cap is spaced from the closure frame and a second position in which the orifice cap is engaged with the upstanding closure member of the closure frame.

In at least one approach, an engine air intake duct is provided. The engine air intake duct may include a duct wall and an orifice cap. The duct wall may extend between an air inlet and an air outlet and may have at least one orifice disposed therethrough. The duct wall may have an integrally-formed closure mechanism adjacent the orifice. The orifice cap may be moveable relative to and securable to the closure mechanism to substantially cover the orifice.

In at least one approach, a method of forming an engine air intake duct is provided. The method may include forming a shell having a duct wall extending between an air inlet and an air outlet and having an orifice disposed therethrough. The shell may have an integrally-formed closure interface adjacent the orifice. The closure interface may include a closure mechanism formed with and disposed on the duct wall, a hinge formed with and extending from the duct wall, and an orifice cap formed with and extending from the hinge.

DETAILED DESCRIPTION

Embodiments of the present disclosure are described herein. It is to be understood, however, that the disclosed embodiments are merely examples and other embodiments may take various and alternative forms. The figures are not necessarily to scale; some features could be exaggerated or minimized to show details of particular components. Therefore, specific structural and functional details disclosed herein are not to be interpreted as limiting, but merely as a representative basis for teaching one skilled in the art to variously employ the present invention. As those of ordinary skill in the art will understand, various features illustrated and described with reference to any one of the figures may be combined with features illustrated in one or more other figures to produce embodiments that are not explicitly illustrated or described. The combinations of features illustrated provide representative embodiments for typical applications. Various combinations and modifications of the features consistent with the teachings of this disclosure, however, could be desired for particular applications or implementations.

Figure 1:
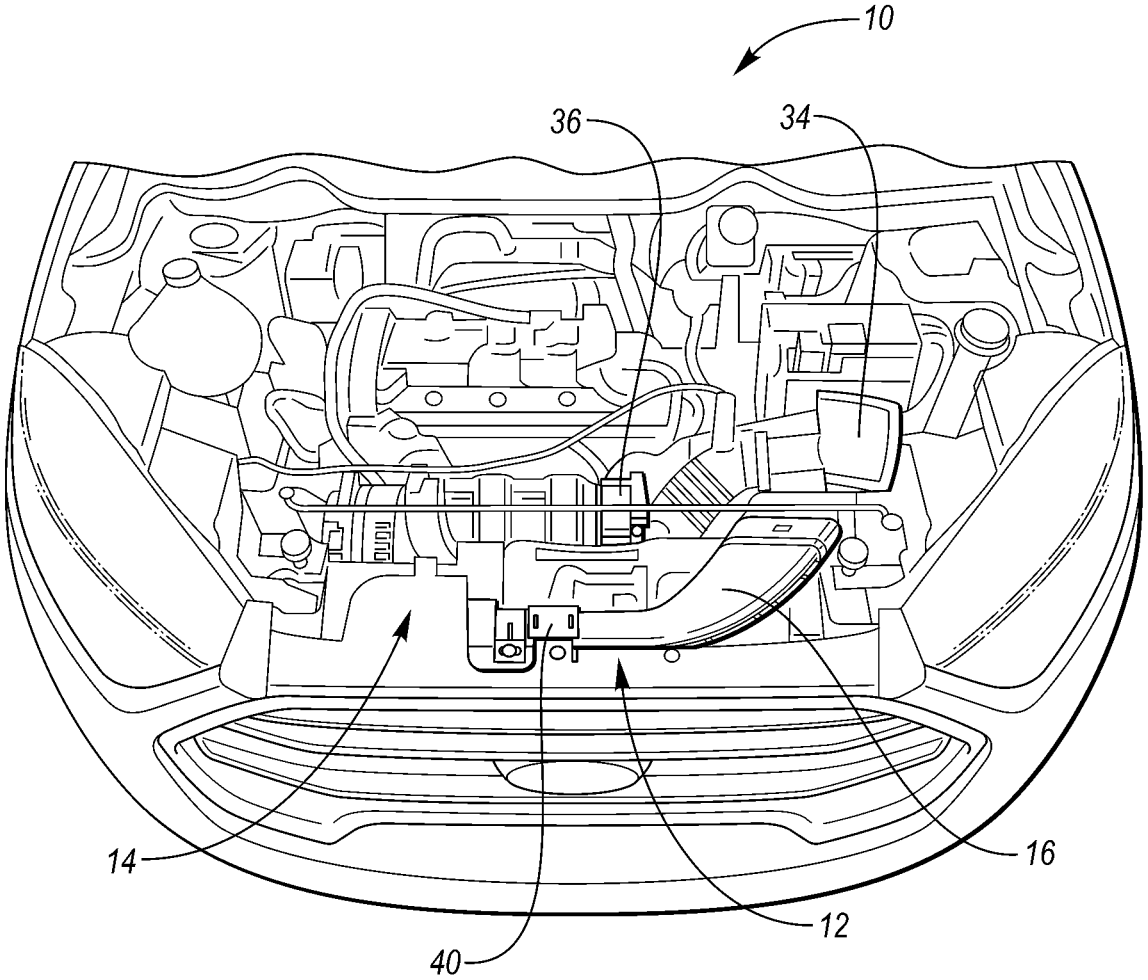
FIG. 1 is a perspective view of a vehicle with an air intake system and an engine.

Referring now to FIG. 1, a vehicle 10 may be provided with an air induction system 12 for providing intake air to an engine 14, such as an internal combustion engine. The air induction system 12 may include an intake duct 16 for receiving and directing the intake air to the engine 14. The intake duct 16 may be designed and intended to be located at an appropriate point upstream of the engine 14. For example, the intake duct 16 may extend in fluid communication with an air cleaner box 34 and an intake plenum and/or throttle body 36. The upstream and downstream ends of intake duct 16 may be connected with the adjoining portions of the air induction system 12 by any suitable approach.

Figure 2:
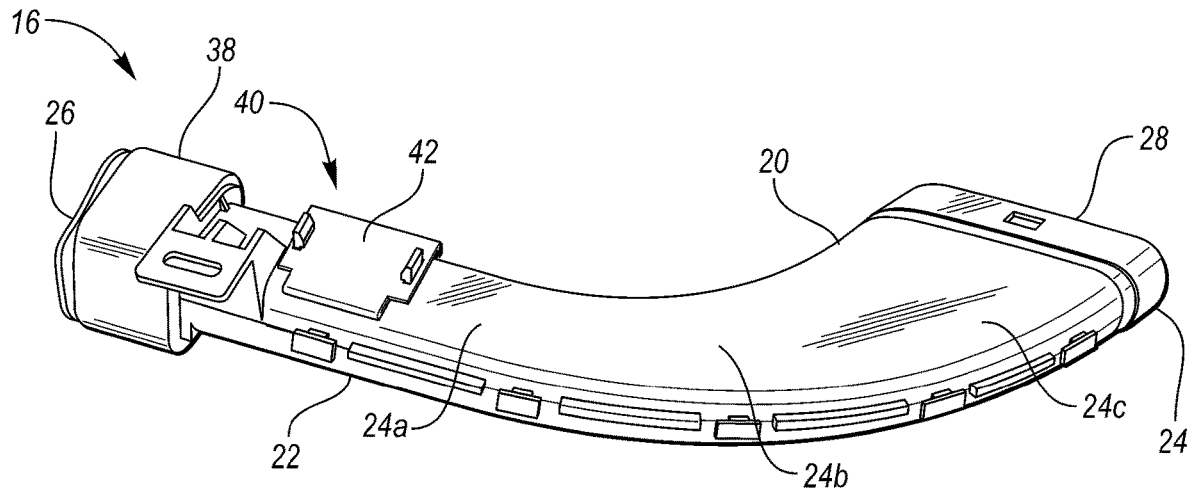
FIG. 2 is a perspective view of an air intake duct.

Referring to FIG. 2, an intake duct 16 may comprise a first body portion 20 and a second body portion 22. The first body portion 20 may be referred to as a top body portion, and the second body portion 22 may be referred to as a bottom body portion. As used herein, "top" and "bottom" may refer to relative positioning of the body portions when the intake duct 16 is in the installed configuration (e.g., as in FIG. 1). The first and second body portions 20, 22 may be formed, for example, of a plastic material, and may be formed by an appropriate process, such as blow-molding or injection-molding. The first body portion 20 may be secured to the second body portion 22 in any suitable manner, such as through an interference fit or mechanical fastener. In still another approach, the intake duct 16 may be formed of more than two body portion. In still another approach, the intake duct 16 may be a one-piece, tubular shell.

In the assembled configuration, the first and second body portions 20, 22 may define a shell 24. The shell 24 may have a top wall, a bottom wall, and sidewalls extending therebetween. The shell 24 may define an air inlet 26 at a first end of the shell 24, and an air outlet 28 at a second end of the shell 24 opposite the first end. The air inlet 26 may draw air into the intake duct 16 (for example, via an air filter positioned upstream of the air inlet 26). The air outlet 28 may provide air to the engine. In one example, the air outlet 28 may be in fluidic communication with downstream components such as a throttle, a compressor, etc.

The shell 24 may define a generally oval cross section and may include an approximately 45° bend. In this way, the shell 24 may define a first region 24*a* proximate and downstream of the air inlet 26, a second region 24*b* downstream of the first region 24*b* and defining a curve or bend, and a third region 24*c* downstream of the second region 24*b* and proximate the air outlet 28. The dimensions and shape of the shell 24 may be based upon many variables and may be influenced by the available package space within the engine compartment.

The intake duct 16 may also include a gasket 38. The gasket 38 may be a foam gasket that may be disposed about the shell 24; for example, at the first region 24*a* proximate the air inlet 26. The gasket 38 may be adapted to inhibit or reduce airflow into the air inlet 26 of the intake duct 16.

One or more components of the intake duct 16 may define an orifice or plurality of orifices. As used herein, an orifice may refer to a hole that extends through an entire thickness of the body through which it is disposed. In this way, fluid (such as air) may pass from outside of the intake duct 16, through the orifice, and into an interior cavity of the intake duct 16.

The orifice or orifices may be disposed at one or more locations of the intake duct. For example, orifices may be disposed through the first body portion 20 at the first region 24*a*, the second region 24*b*, or the third region 24*c*, through the second body portion 22 at the first region 24*a*, the second region 24*b*, or the third region 24*c*, or any combination thereof. In one example approach, the second body portion 22 has a first plurality of orifices disposed through the first region 24*a* and a second plurality of orifices disposed through the second region 24*b*.

Figure 3:
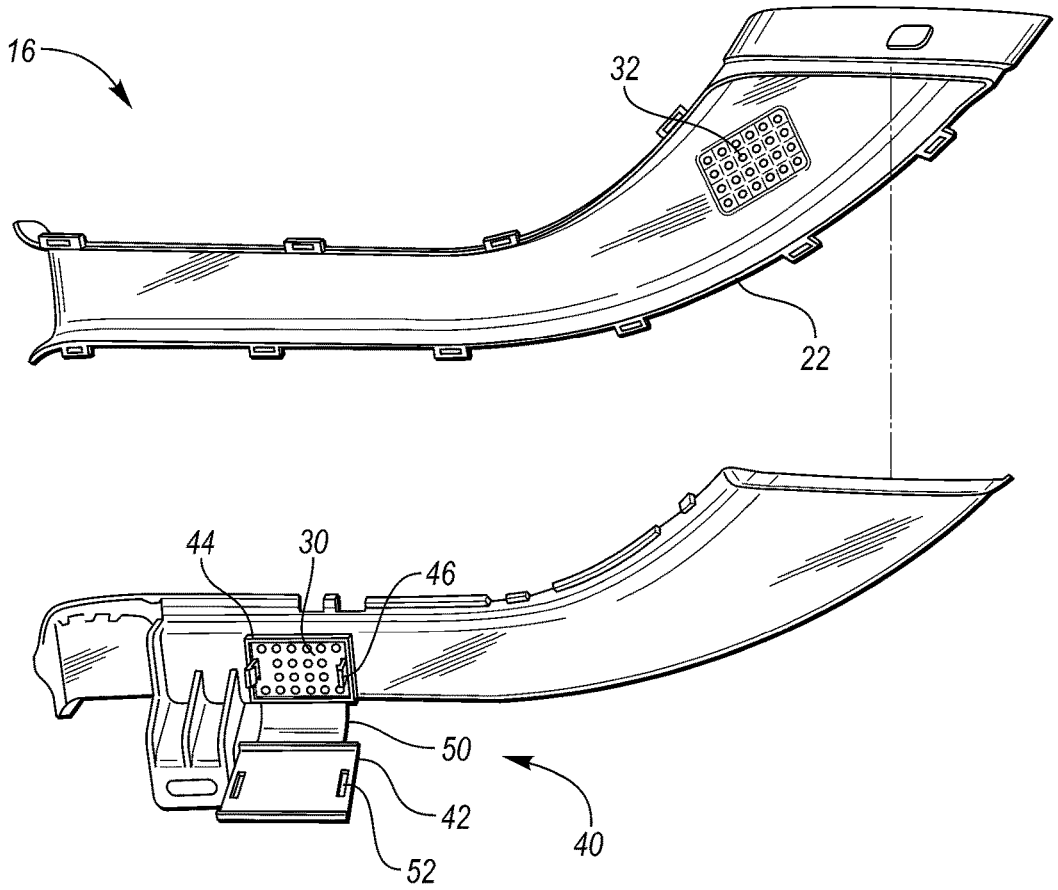
FIG. 3 is an exploded perspective view of the air intake duct of FIG. 2.

Referring to FIG. 3, the first body portion 20 may define a first orifice or plurality of orifices 30 (which may be arranged, for example in an array or matrix). The first plurality of orifices 30 may include a plurality of rows and columns of aligned orifices. For example, an array may have at least two orifices aligned in a column and at least two orifices aligned in a row extending orthogonal to the column.

The first plurality of orifices 30 may be formed in the first body portion 20 proximate the air inlet 26. The second body portion 22 may define a second orifice or plurality of orifices 32 (which may be arranged, for example in an array or matrix). The second plurality of orifices 32 may include a plurality of rows and columns of aligned orifices. The second plurality of orifices 32 may be formed in the second body portion 22 proximate the air outlet 28. The orifices may contribute to the reduction or mitigation of acoustic resonances in the intake duct 16.

Figure 4:
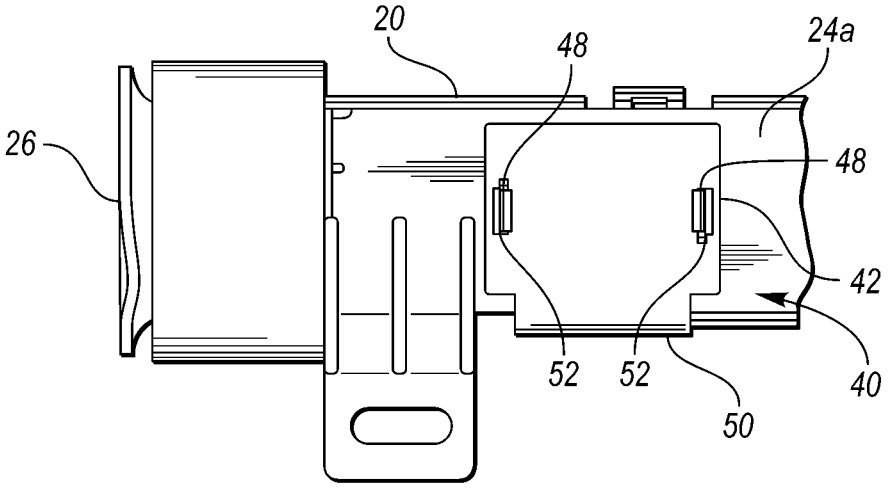
FIG. 4 is a top plan view of a portion of an air intake duct with a first closure interface in a first configuration.
Figure 5:
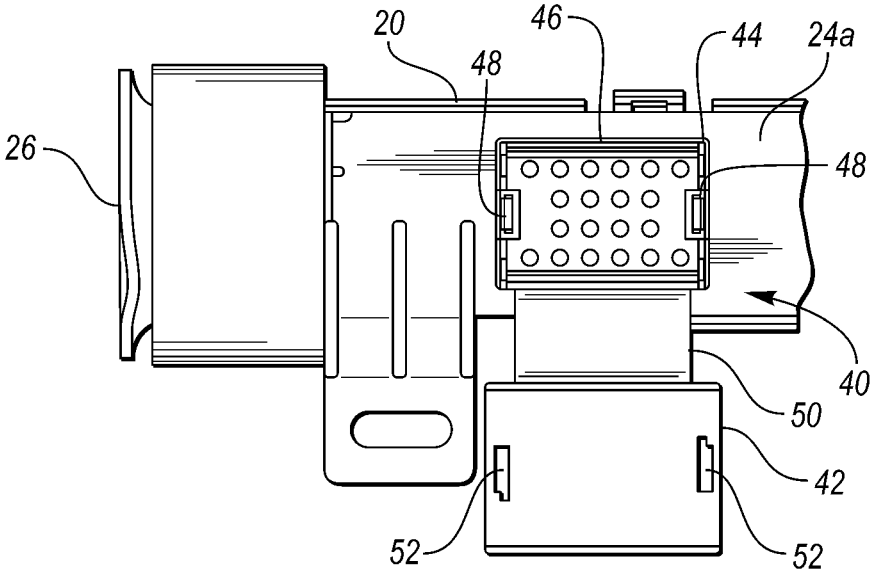
FIG. 5 is a top plan view of the portion of the air intake duct of FIG. 4 with the first closure interface in a second configuration.
Figure 6:
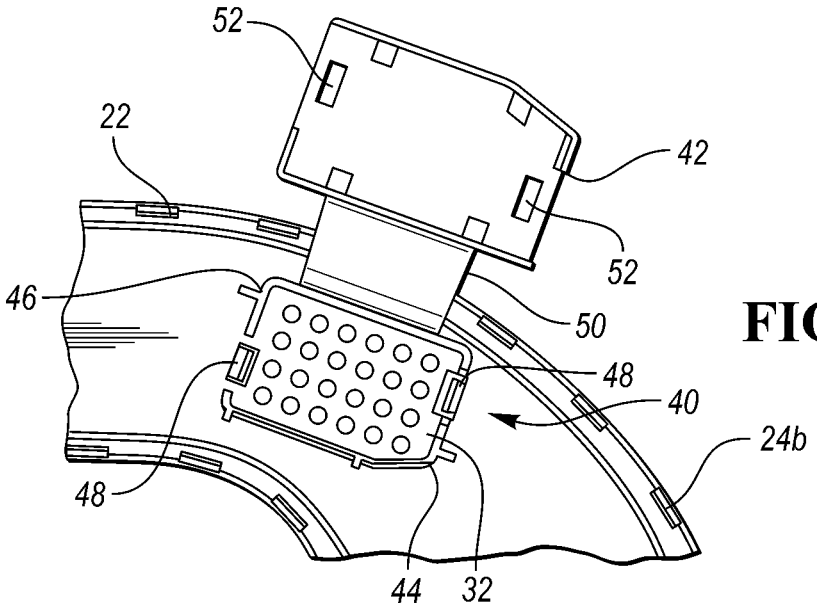
FIG. 6 is a bottom plan view of a portion of an air intake duct with a second closure interface.

Referring now to FIGS. 4-6, the intake duct 16 may include a closure interface 40. The closure interface 40 may be formed such that an orifice cap 42 may be secured to the shell 24 to substantially cover the orifices. The orifice cap 42 may engage the shell 24, for example, at a closure frame 44.

The closure frame 44 may include one or more upstanding walls 46 disposed at a perimeter of the orifices 30, 32. The walls 46 may extend away from the shell 24.

The closure frame 44 may also include one or more closure features, such as an upstanding closure member 48. The upstanding closure member 48 may be disposed at a periphery of the closure frame 44. The upstanding closure member 48 may have a neck region and a head region. The head region may have a width or thickness greater than that of the neck region. In at least one approach, the upstanding closure member 48 may be a slide lock adapted to be received in a slide lock interface of the orifice cap 42. In at least another approach, the upstanding member may be a resilient tab. The resilient tabs may have head region extending from the neck region and forming a sloped upper surface and a lower lip surface. The resilient tabs may be adapted to flex in response to a biasing force at the sloped upper surface, and to return to an unflexed position in the absence of a biasing force.

The closure frame 44, upstanding walls 46, and the upstanding closure member 48 may be individually or collectively referred to as a closure mechanism.

The orifice cap 42 may be secured to the shell 24 through a hinge 50. In at least one approach, the hinge 50 is a living hinge. The living hinge may extend from the closure frame (e.g., In this way, movement of the orifice cap 42 toward and away from the closure frame 44 may cause the hinge 50 may flex (e.g., rotate) between various positions.

In still another approach, the hinge 50 includes a hinge pin that may rotatably secure the orifice cap 42 to the shell 24. In still another approach, the orifice cap 42 may be a removable cap that is not connected to the shell 24 (e.g., is a discrete component not connected through a hinge).

The orifice cap 42 may include one or more closure features that may be, for example, complementary to the closure features of the closure frame 44. In at least one approach, the orifice cap closure features may be apertures 52 disposed opposite, and sized and adapted to receive, the upstanding members 48 of the closure frame 44. In the slide lock approach, the apertures 52 may be irregularly-shaped apertures adapted to receive the head regions of the slide lock upstanding closure member 48 in an enlarged region of the aperture 52, and may be moved (e.g., slid or rotated) such that the neck region is received in a narrowed region of the aperture 52. In this way, the head region may engage a top surface of the orifice cap 42 to inhibit movement of the orifice cap 42 (e.g., in a distance away from the shell 24). In the resilient tab approach, engagement between the orifice cap 42 and the resilient tabs (e.g., at the sloped surface of the head region) may cause the orifice cap 42 to bias the resilient tabs to a flexed position. When the head region is sufficiently received in the aperture 52, the sloped surface may no longer engage the orifice cap 42, and the resilient tab may return to an unflexed (e.g., relaxed) position. In this position, the lip surface may engage a top surface of the orifice cap 42 to inhibit movement of the orifice cap 42 (e.g., in a distance away from the shell 24).

In at least one approach, a closure interface 40 may be integrally formed with at least a portion of the intake duct 16. For example, when the intake duct 16 is a one-piece shell 24, the closure interface 40 may be integrally formed with the one-piece shell 24. When the intake duct 16 is a multicomponent shell 24 (e.g., having first and second body portions 20, 22), a closure interface 40 may be integrally formed on one or more of the components. As used herein, "integrally formed" may refer to the closure interface 40 and the shell component being created or constructed as a single unit or component in a manufacturing process. The integrally formed closure-shell component may be formed, for example, through blow-molding, injection-molding. Other suitable manufacturing processes such as casting are contemplated.

The closure interface 40 may be adapted to reduce fluid flow from an exterior of the intake duct 16 through the orifices 30, 32 to an internal cavity of the intake duct 16. For example, when the orifice cap 42 is engaged with the closure frame 44, the closure interface 40 may partially or completely cover (e.g., extend over) the orifices 30, 32 to reduce heated air produced by the engine 14 from being admitted into the internal cavity of the intake duct 16. Partial or complete coverage of the orifice cap 42 over the orifices 30, 32 may also reduce water from entering the internal cavity of the intake duct 16.

In at least one approach, the upstanding walls 46 may extend a height from the shell 24 such that when the orifice cap 42 is in the closed configuration, the upstanding walls 46 are spaced from the orifice cap 42. In this approach, the orifice cap 42 and the upstanding walls 46 may define a gap therebetween. The gap may be, for example approximately 1 millimeter to approximately 6 millimeters, and more particularly, approximately 2 millimeters. The gap may be optimized such that a reduced airflow may pass through the closure interface 40, through the orifices, an into an internal cavity defined by the shell 24. The reduced airflow may mitigate resonance at the intake duct 16. In still another approach, the upstanding walls 46 may extend a sufficient height from the shell 24 such that when the orifice cap 42 is in the closed configuration, the upstanding walls 46 engage the orifice cap 42 (e.g., at a bottom surface of the orifice cap 42).

FIGS. 4 and 5 depict an exemplary closure interface 40 disposed in the first body portion 20 at a first region 24*a* of the shell 24. In FIG. 4, the orifice cap 42 is disposed in a first configuration, that may be referred to as a closed configuration. In the closed configuration, the orifice cap 42 engages the shell 24; for example, at the closure frame 44. More particularly, the orifice cap 42 may engage the upstanding closure member 48 of the closure frame 44. For example, the resilient tabs of the closure frame 44 may engage and inhibit movement of the orifice cap 42 relative to the closure frame 44. In this configuration, the orifice cap 42 extends over the orifices 30, 32 that extend through the first body portion 20.

In at least one approach, a method of forming an engine air intake duct is provided. The method may include forming a shell having a duct wall extending between an air inlet and an air outlet and having an orifice disposed therethrough. The shell may have an integrally-formed closure interface adjacent the orifice. The closure interface may include a closure mechanism formed with and disposed on the duct wall, a hinge formed with and extending from the duct wall, and an orifice cap formed with and extending from the hinge.

In at least one approach, the shell, the closure mechanism, the hinge, and the orifice cap may be a one-piece component integrally formed in a molding process. The molding process may include forming the hinge in an extended configuration. The method may further include, after the molding process, rotating the orifice cap relative to the duct wall to flex the hinge from the extend configuration to a bent configuration. The method may further include engaging the closure mechanism with the orifice cap to mechanically secure the orifice cap to the closure mechanism over the orifice.

While exemplary embodiments are described above, it is not intended that these embodiments describe all possible forms encompassed by the claims. The words used in the specification are words of description rather than limitation, and it is understood that various changes may be made without departing from the spirit and scope of the disclosure. As previously described, the features of various embodiments may be combined to form further embodiments of the invention that may not be explicitly described or illustrated. While various embodiments could have been described as providing advantages or being preferred over other embodiments or prior art implementations with respect to one or more desired characteristics, those of ordinary skill in the art recognize that one or more features or characteristics may be compromised to achieve desired overall system attributes, which depend on the specific application and implementation. These attributes may include, but are not limited to cost, strength, durability, life cycle cost, marketability, appearance, packaging, size, serviceability, weight, manufacturability, ease of assembly, etc. As such, embodiments described as less desirable than other embodiments or prior art implementations with respect to one or more characteristics are not outside the scope of the disclosure and may be desirable for particular applications.

What is claimed is:

1. A vehicle comprising:

an engine; and an air intake system adapted to direct airflow to the engine, the air intake system having an air intake duct that includes a first body portion secured to a second portion to form a shell, the shell defining an air inlet at a first end and an air outlet at a second end opposite the first end, wherein the first body portion defines a plurality of orifices disposed therethough and an integrally-formed closure interface disposed adjacent the plurality of orifices and including a closure frame having an upstanding wall extending from the first body portion about a perimeter of the plurality of orifices and an upstanding closure member extending from the first body portion, a hinge connected to and extending from the closure frame, and an orifice cap connected to and extending from the hinge and having an aperture sized to receive the upstanding closure member, wherein the orifice cap when engaged with the upstanding closure member extends over and covers the plurality of orifices, and is spaced from at least a portion of the upstanding wall to define a gap between the orifice cap and upstanding wall that permits air flow through the integrally-formed closure interface, through the plurality of orifices, and into an internal cavity defined by the shell.

2. The vehicle of claim 1 wherein the plurality of orifices is arranged proximate at least one of the air inlet and the air outlet to reduce acoustic resonances in the air intake duct.

3. An air intake system for an engine, comprising:

an air intake duct defining an air inlet at a first end, an air outlet at a second end opposite the first end, a plurality of orifices disposed therethrough, and an integrally-formed closure interface disposed adjacent the plurality of orifices, wherein the integrally-formed closure interface includes a closure frame having an upstanding wall extending from the first body portion about a perimeter of the plurality of orifices and an upstanding closure member extending from the first body portion, a hinge connected to and extending from the closure frame, and an orifice cap connected to and extending from the hinge and having an aperture sized to receive the upstanding closure member, wherein the orifice cap when engaged with the upstanding closure member extends over and covers the plurality of orifices, and is spaced from at least a portion of the upstanding wall to define a gap between the orifice cap and upstanding wall that permits air flow through the integrally-formed closure interface, through the plurality of orifices, and into an internal cavity defined by the air intake duct.

4. The air intake system of claim 3, wherein the upstanding closure member is a resilient tab adapted to flex between a relaxed position and a biased position.

* * * * *